US010533327B2

(12) United States Patent
Dwyer, III

(10) Patent No.: US 10,533,327 B2
(45) Date of Patent: Jan. 14, 2020

(54) RIGGING LIFT AND METHOD OF USE

(71) Applicant: Aerial Arts, Inc., Indianapolis, IN (US)

(72) Inventor: Herbert L. Dwyer, III, Noblesville, IN (US)

(73) Assignee: Aerial Arts, Inc., Indianapolis, IN (US)

( * ) Notice: Subject to any disclaimer, the term of this patent is extended or adjusted under 35 U.S.C. 154(b) by 0 days.

(21) Appl. No.: 16/169,529

(22) Filed: Oct. 24, 2018

(65) Prior Publication Data

US 2019/0127995 A1 May 2, 2019

Related U.S. Application Data

(60) Provisional application No. 62/578,033, filed on Oct. 27, 2017.

(51) Int. Cl.

| | |
|---|---|
| ***E04G 5/00*** | (2006.01) |
| ***B66C 17/06*** | (2006.01) |
| ***E04F 17/04*** | (2006.01) |
| ***E04G 3/32*** | (2006.01) |
| ***E04G 3/34*** | (2006.01) |
| ***E04G 3/24*** | (2006.01) |
| ***B66C 23/16*** | (2006.01) |
| ***B66D 1/60*** | (2006.01) |
| ***E04H 3/10*** | (2006.01) |
| *E04B 1/342* | (2006.01) |

(52) U.S. Cl.

CPC ..... *E04G 5/007* (2013.01); *B66C 17/06* (2013.01); *B66C 23/16* (2013.01); *B66D 1/60* (2013.01); *E04F 17/04* (2013.01); *E04G 3/246* (2013.01); *E04G 3/32* (2013.01); *E04G 3/34* (2013.01); *E04H 3/10* (2013.01); *B66C 2700/03* (2013.01); *E04B 1/342* (2013.01)

(58) Field of Classification Search

CPC ..... E04G 5/007; E04G 3/246; E04G 3/32; E04G 3/34; B66C 17/06; B66C 17/04; B66C 23/16; B66D 1/60; E04H 3/10

See application file for complete search history.

(56) References Cited

U.S. PATENT DOCUMENTS 624,567 A * 5/1899 Stone ..... E04G 1/20 182/14
2,645,531 A * 7/1953 Rector ..... E04G 3/30 182/37
3,842,986 A * 10/1974 Hupkes ..... B66C 13/06 212/330
3,971,478 A * 7/1976 Matasa ..... B66C 1/24 212/274
4,360,112 A * 11/1982 Brewer ..... B66C 17/06 105/163.1

(Continued)

*Primary Examiner* — Paola Agudelo
(74) *Attorney, Agent, or Firm* — Quarles & Brady LLP

(57) ABSTRACT

A method of constructing a structure in which an item is to be installed at an elevated height on the structure. Hoists are hung from the structure. A platform is moved from ground level and positioned at a first elevated position between ground level and the hoists. The platform is attached to the hoists at the first elevated position. After the platform has been attached to the hoists, the item is moved onto the platform. The item is lifted on the platform to a second elevated position for installation at the elevated height on the structure and the item is installed at the elevated height.

21 Claims, 14 Drawing Sheets

(56) References Cited

U.S. PATENT DOCUMENTS

| | | | | | |
|---|---|---|---|---|---|
| 4,385,583 | A * | 5/1983 | Ayers | B63B 1/14 | 114/265 |
| 4,811,819 | A * | 3/1989 | Sugiyama | E04G 3/34 | 182/129 |
| 5,431,246 | A * | 7/1995 | Matherly | E04G 3/34 | 182/37 |
| 5,782,446 | A * | 7/1998 | Ghahremani | E04G 3/34 | 248/220.21 |
| 5,845,739 | A * | 12/1998 | Ohtsuki | E04G 3/34 | 182/37 |
| 2003/0178254 | A1* | 9/2003 | Swanenberg | E04G 3/30 | 182/142 |
| 2014/0190919 | A1* | 7/2014 | Rosberg | B66C 19/02 | 212/179 |
| 2014/0346131 | A1* | 11/2014 | Wang | E04G 21/167 | 212/312 |
| 2015/0151932 | A1* | 6/2015 | Toncelli | B66C 17/06 | 414/788.4 |
| 2016/0096710 | A1* | 4/2016 | Hanley | B66D 1/60 | 254/332 |

* cited by examiner

RIGGING LIFT AND METHOD OF USE

CROSS-REFERENCE TO RELATED APPLICATION

This application claims the benefit of U.S. Provisional Patent Application No. 62/578,033 filed Oct. 27, 2017, which is hereby incorporated by reference for all purposes as if set forth in its entirety herein.

STATEMENT OF FEDERALLY SPONSORED RESEARCH OR DEVELOPMENT

Not applicable.

TECHNICAL FIELD

This disclosure relates to rigging lifts for the construction of large structures such as, for example, stadiums in which ducting or other components are to be attached to the structure at an elevated height.

BACKGROUND

In the construction of large buildings, such as stadiums, it is often necessary to install heavy and/or large components at an elevated height. For example, HVAC ducts often need to be lifted and installed in place on beams supporting the roof or along walls of the building. Such ducts or components, because of their size or weight, may present difficulties because they may need to be lifted hundreds of feet from the ground and installed in place by highly skilled workers.

Even under ideal conditions, installation of large objects at great height can pose a challenge. However, such installations can be greatly complicated by other factors. For example, increasing bold architectural designs are being presented which creates pragmatic challenges to construction. Further still, during the construction of large structures, various contractors—often working on different parts of the building—will often work at once in relatively close proximity to one another. Still yet, if the overall construction is not carefully managed and stages are not sequenced efficiently, then the installation of certain building elements can be severely complicated by the pre-existing work.

Thus, there remains a need for more robust and flexible systems and methods for construction.

SUMMARY

Disclosed herein is a system and method for installing large items, such as HVAC ducts, at an elevated height in the construction of a building, such as a stadium. Notably, this method permits increased flexibility in construction order and allows installation or work to be done in regions of the building that may be difficult to access in other ways (e.g., directly by crane).

A method is disclosed of constructing a structure in which an item is to be installed at an elevated height on the structure. Hoists are hung from the structure. A platform is moved from ground level and positioned at a first elevated position between ground level and the hoists. The platform is attached to the hoists at the first elevated position. After the platform has been attached to the hoists, the item is moved onto the platform. The item is lifted on the platform to a second elevated position for installation at the elevated height on the structure and installed at the elevated height.

In some forms of the method, the step of hanging the hoists on the structure may be performed by riggers. In some forms of the method, the platform may be vertically movable over a distance exceeding 200 feet by the hoists.

In some forms of the method, the step of installing the item at elevated height may involve mechanically attaching the item to the structure for support by the structure independent of support by the platform.

In some forms of the method, the method may further include the step of assembling the platform at ground level prior to picking up the platform. This assembly may occur prior to, after, or contemporaneously with the hanging of the hoists. The platform may be assembled from multiple joined truss sections with walkboards received thereon and railing supported thereby so that the platform can receive the item and/or workers thereon.

In some forms of the method, the step of moving the platform from ground level and positioning the platform at a first elevated position between ground level and the hoists involves raising and positioning the platform with a crane. It is contemplated that the platform may be supported by a heavy duty polyester sling, for example, when the platform is positioned with the crane.

In some forms of the method, a portion of the structure may be located directly beneath an installation site at the elevated height at which the item is installed. For example, the structure may be a stadium and the portion of the structure that is located directly beneath the installation site is bowl seating. In such a case (as may result from sequencing seating assembly before the hanging of items such as HVAC duct), lifting the platform via the hoists directly from the ground may not be feasible because of the interference of the pre-installed bowl seats.

In some forms of the method, the item may be one of various objects. For example, the item may be an HVAC duct—which for large stadiums can be quite large and heavy, making them onerous to lift to the elevated height to install. However, it is contemplated that such a platform may be used in conjunction with other objects including, but not limited to, display screens or scoreboards, other utility components (wires, pipes, WiFi components, and so forth), lighting fixtures, and so forth.

In some forms of the method, the platform may include a super duty truss supporting aluminum walk boards. In some forms, such as in the embodiment illustrated herein, the platform may be an eight hoist platform having a gross capacity of 35,280 pounds (16 metric tons) and a net capacity of 24,280 pounds. Note that as used herein gross capacity refers to combined weight of the platform, the suspension mechanisms (e.g., ropes, cables, and so forth) for suspending the platform, and rated capacity, whereas net capacity simply refers to the rated capacity of material that can be lifted using the platform. Of course, other hoist configurations may provide other capacities. This represents a sizable difference from other "swing stage" type construction site platforms.

In some forms of the method, the platform may be moved from a second elevated position to a third elevated position. This additional movement may be effectuated by attaching the platform to an additional subset of hoists in which the additional subset of hoists includes hoists not included in an original subset of hoists attached to the platform and by detaching at least a portion of the subset of original hoists. The attaching and detaching of subsets of hoists can result in the walking the platform which may occur, at least partially, in a horizontal direction relative to ground level. In some situations, the platform may be walked a plurality of times, with the platform being lowered after every walk to receive a new item and which is then lifted back up, thereby permitting the installation of multiple items over a distance.

Still yet, in some forms of the method, walking the platform may place of the platform in the structure at a location at which a crane would be incapable of placing the platform based on a geometry of the roof under which the platform is to be positioned. For example, a steep overhang may make it difficult to position the platform, but for the walking.

In some forms of the method, the hoists may be operable using a control system, such as for example, a remote control system. The hoists may be independently operable by the control system. It is contemplated that the control system may have some number of failsafe built in such as automatic shutoffs if some hoists become slack. However, it is also contemplated that all may be manually controlled by a skilled operator.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
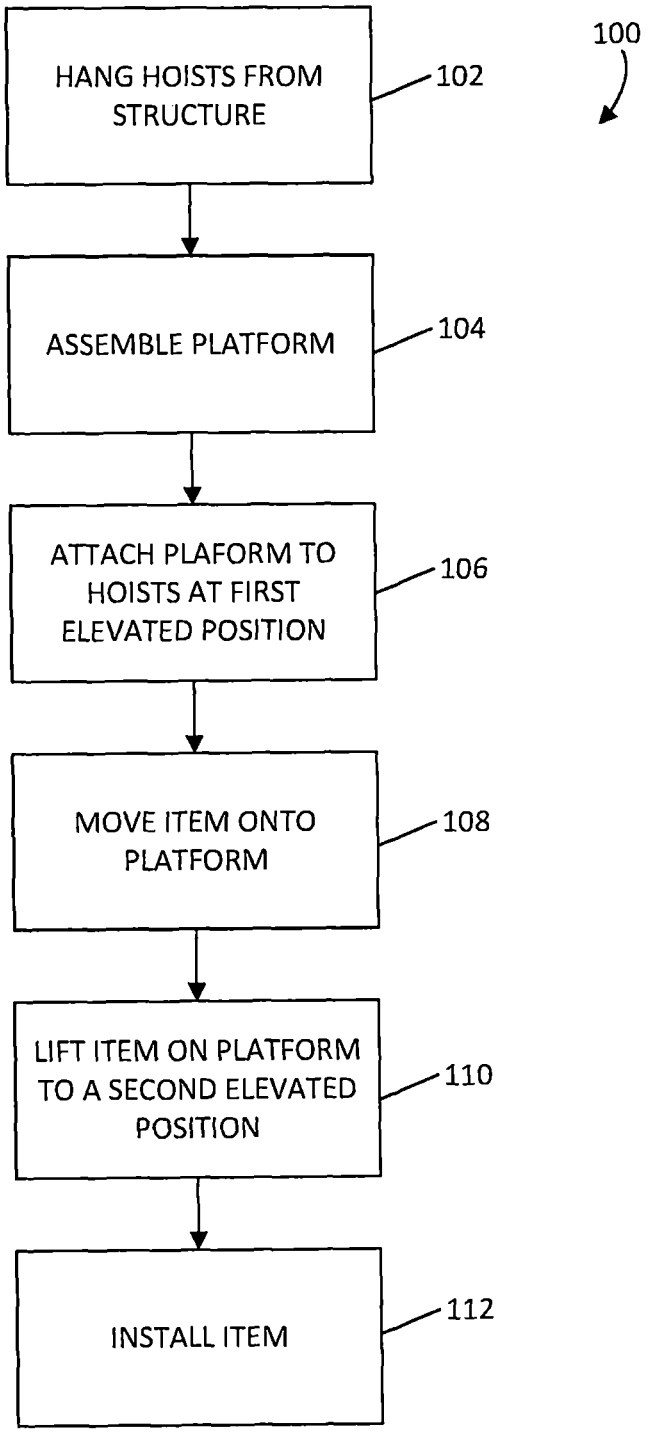
FIG. 1 is process chart identifying a method of constructing a structure in which an item is to be installed at an elevated height on the structure.

Referring first to FIG. 1, a method 100 is illustrated of constructing a structure in which an item is to be installed at an elevated height on the structure. This method involves hanging a number of hoists on the structure according to a step 102 and assembling a platform according to a step 104, lifting and attaching a platform to the hoists with the platform at a position above ground level according to a step 106, moving an item onto the platform at a location above ground level (but lower than the installation position) according to a step 108, lifting the item on the platform to an installation height according to step 110, and installing the item at the installation height according to a step 112.

Figure 2A:
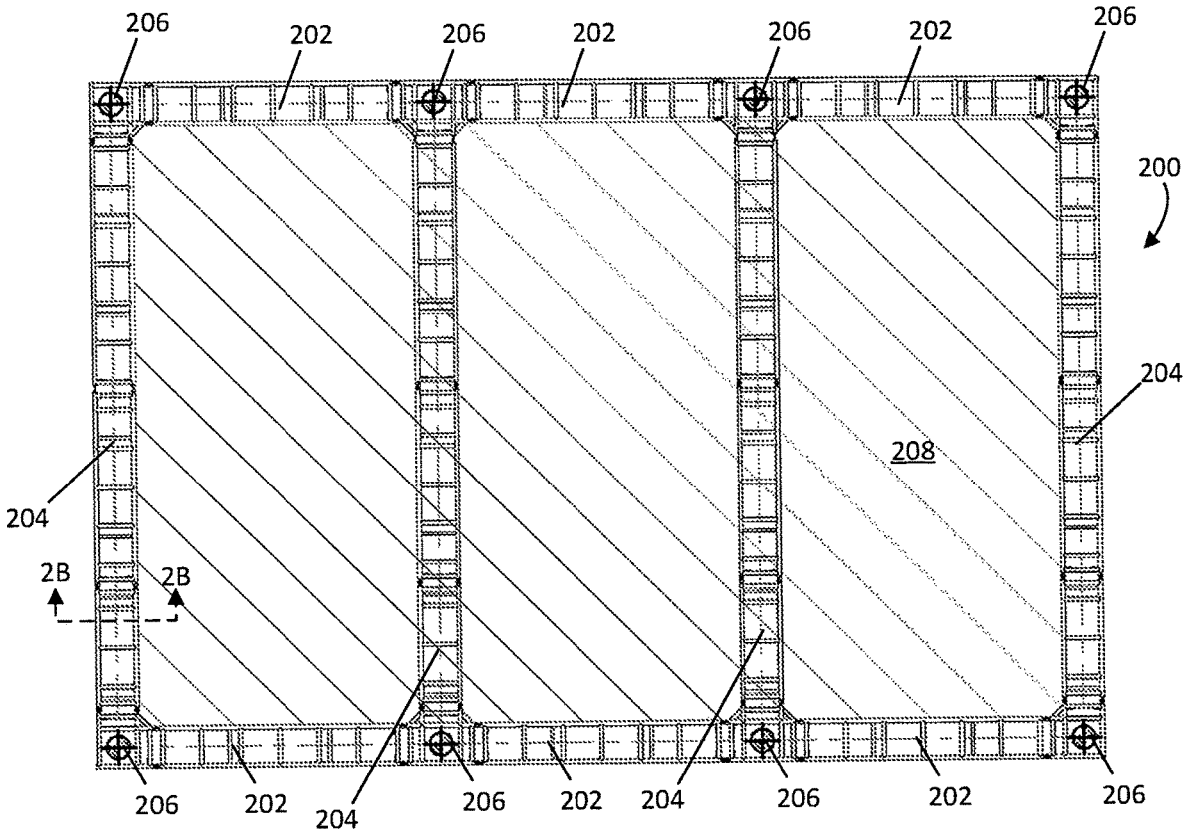
FIG. 2A is a top plan view of a platform.
Figure 2B:
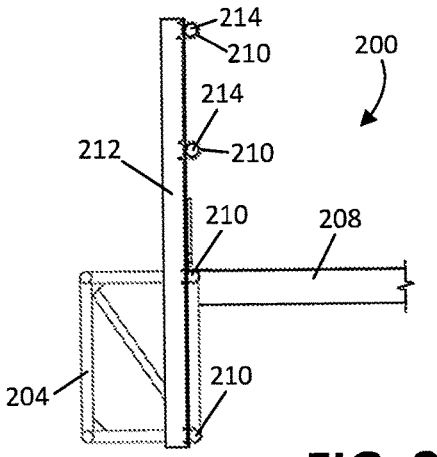
FIG. 2B is a side view of an edge of the platform of FIG. 2B in which the attached railing and walkboards are shown attached to the truss of the platform.

An exemplary form of this method 100 will now described with further reference to FIGS. 2A and 2B which depict an exemplary platform for use with the method 100 and FIGS. 3A-3G which depict, sequentially, the performance of the steps of the method 100.

Figure 3A:
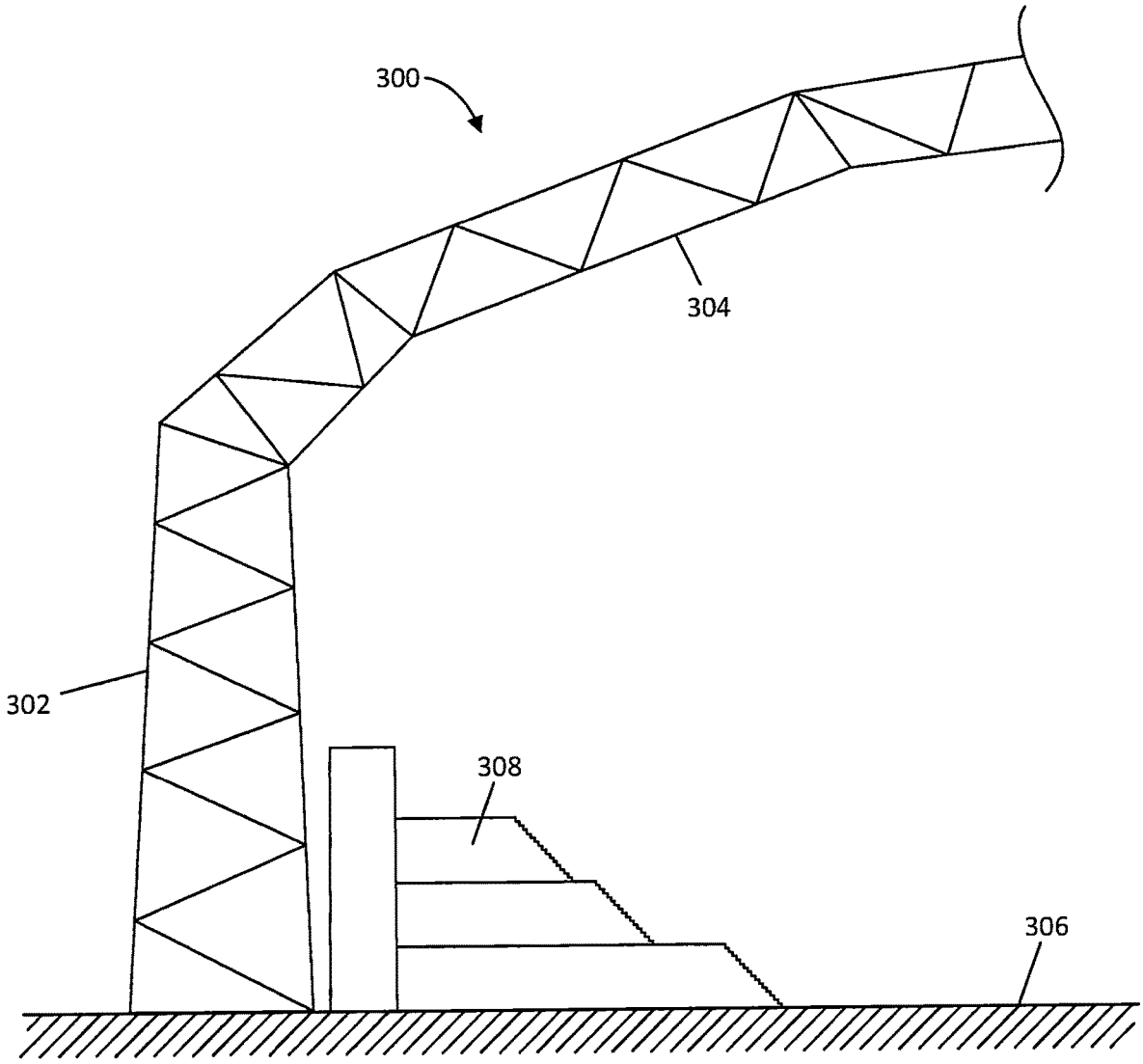
FIG. 3A-3G are views schematically depicting an exemplary sequence of process steps in which an item is installed at an elevated height of a structure (here, a HVAC duct is attached to a roof of a stadium directly above pre-installed lower bowl seating which serves as an obstacle).

Now with reference to FIG. 3A, a portion of structure in the form of a stadium 300 is illustrated part way through construction of the stadium 300. It will be appreciated that the depiction of the structure is largely simplified and the specifics of the depicted structure are purely by way of example only for the purpose of generically describing the method 100. The stadium 300 includes various a support members that form a side wall 302 and transition into a roof 304 of the structure. At ground level 306, there may be a surface (or series of surfaces) which may form a playing field and/or a foundation on which additional structure, such as lower bowl seating 308, may be constructed or supported.

It should be appreciated that in the context of the description that follows "ground level" is undoubtedly a somewhat relativistic term because there may well be portions of the structure beneath ground level (e.g., a basement or other subterranean structures); however, as will be apparent from the description that follows, ground level will be a position or height of a lower surface of the structure upon which further construction activities may take place (e.g., the assembly of the platform according to step 104, the support of a crane or other substantial lifting machine) and would exclude structure further constructed beyond it, such as lower bowl seating 306, upon which the construction activities that are further described (e.g., the assembly of the platform according to step 104, the support of a crane or other substantial lifting machine) could not be performed.

Figure 3B:
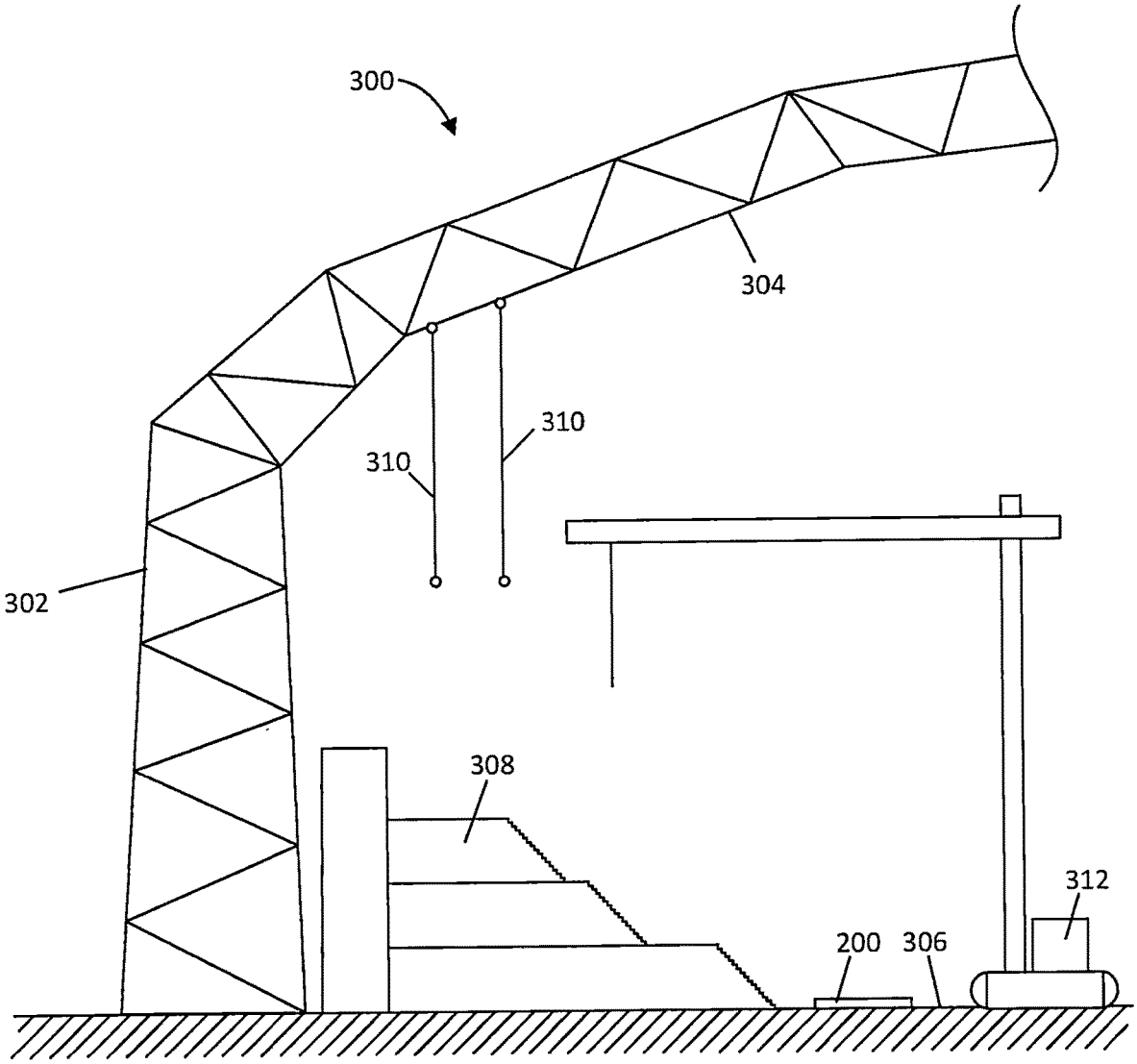

Turning now to FIG. 3B, the preparation stages for installation of an item, here an HVAC duct, to the structure 300 at an elevated height is illustrated. Among other things, hoists 310 are attached to an underside of the roof 304 of the structure 300 as one example of step 102, a platform 200 is assembled at ground level 306 as one example of step 104, and a crane 312 may be presented at ground level 306 for the subsequent lifting of the platform 200 to the lower end of the hoists 310 and attachment thereto at a first elevated position according to step 106 (depicted in FIGS. 3C and 3D).

Figure 5:
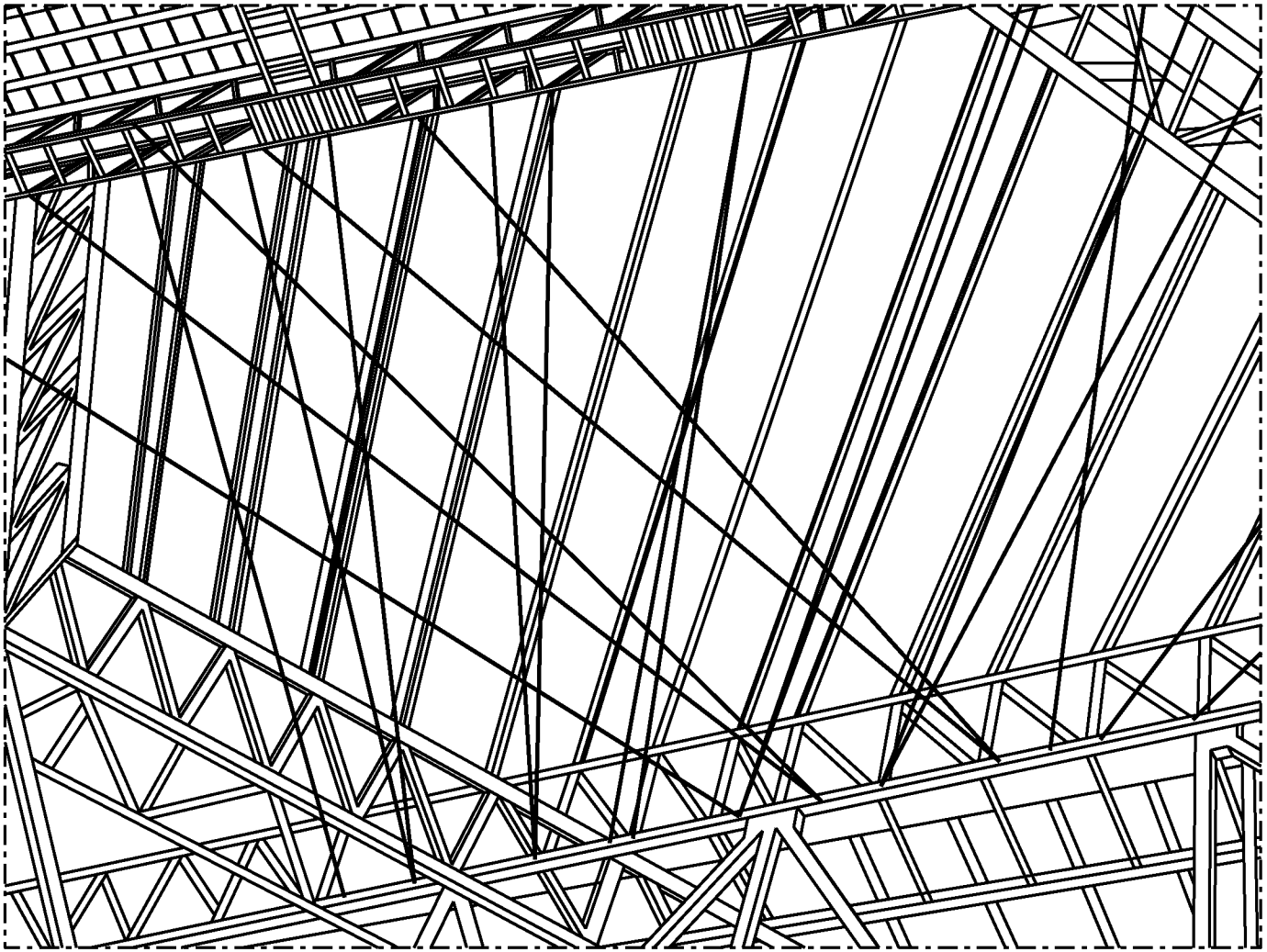
FIG. 5 is a photograph illustrating beam-to-beam rigging of lines or cables which may be used to move the platform throughout the region beneath the lines.

With respect to the attachment of the hoists 310 to the roof 306, such attachment may be performed by riggers (such as the type of riggers that construct trusses for concert performances) on the roof 306 or on structures attached to the roof 306 such as for example, beams or trusses that form part of the stadium. An upper end of these hoists 310 may be attached to the roof 306 or surrounding structure, which chains or other suspension mechanisms (e.g., ropes, cables, and so forth) extend down to connection points which will be eventually attached to the platform 200 mid-air. It is contemplated that in some forms, a system of cables and chains may be hung between beams such that the platform can be to position exactly where it needs to go for the work along the cables and chains. See for example, FIG. 5. Illustrating cables and chains that run from one beam to another that serve as an intermediate pot for connection of the hoists. Thus, a big difference between this system and standard rental platforms, is that a beam does not need to be directly over the work in order to place the platform at a location. Although only two hoists are schematically indicated, there may additional hoists (for example, eight hoists) which may each include a motor arrangement able to lengthen or shorten the distance from the top of the respective hoist to the bottom of the respective hoist. In some instances, the mechanized portion of the hoists may be a part of the mounted hoist itself, however, it is contemplated that the mechanized portion enabling lengthening or shortening may be received on or supported by the platform 200 in some forms and coupled to the other portion of the hoist that is mounted to the roof. It is contemplated that the hoists 310 may be independently operable, may be operable together, and with or without built in fail safes based on, for example, a slack condition in the various hoists. It will be appreciated that, in any event, the operation of the hoists demands complete attention of the operator, who is familiar with the system and its function.

With respect to the platform 200, reference is made to FIGS. 2A and 2B, which depict the structure of the platform 200 in greater detail. For portability, the platform 200 may be brought in pieces and constructed at ground level 306. Various super duty truss sections 202 and 204 may be connected at corner blocks 206. In the form shown, six super duty truss sections 202 are laid out 2×3 and connected by four super duty truss sections 204 at the corner block 206 to form three rectangles. In the particular embodiment illustrated, the truss sections 202 are approximately 13 feet long, while the truss sections 204 are approximately 26 feet long to form an overall platform 200 that is approximately 39 feet by 26 feet. It is contemplated that the truss sections could be single sections or multiple sections joined together, for example, by pins or fasteners. A series of aluminum walkboards 208 (e.g., Werner 412 aluminum walkboards) are supported by the rectangular truss structure of the platform 200. As shown in FIG. 2B, U-bolts 210 may be used to attach an upright beam 212 at various sections of the truss sections and cross pipes 214 may also be connected by U-bolts 210 to the upright beam 212 along with a lower plywood kick plate 214 to create a railing on at least the long sides of the platform 200.

It will be noted that platform 200 can be engineered to have eight hoists and support a 24,280 pound load distributed centrally along its longer dimension, which is effectively the net capacity of the platform. Taking into account the weight of the platform and suspension mechanisms, the gross capacity of the platform is 35,280 pounds. To this end, the materials for the trusses and the corner blocks are designed to safely accommodate this load. In one configuration, each of the corner blocks 206 of the platform at three-way junctions provide a mounting point for one of the hoists and may be rated for an 8,000 pound load (maximum) and each of the corner blocks 206 of the platform at two-way junctions provide a mounting point for one of the hoists and may be rated for a 6,000 pound load (maximum).

Figure 3C:
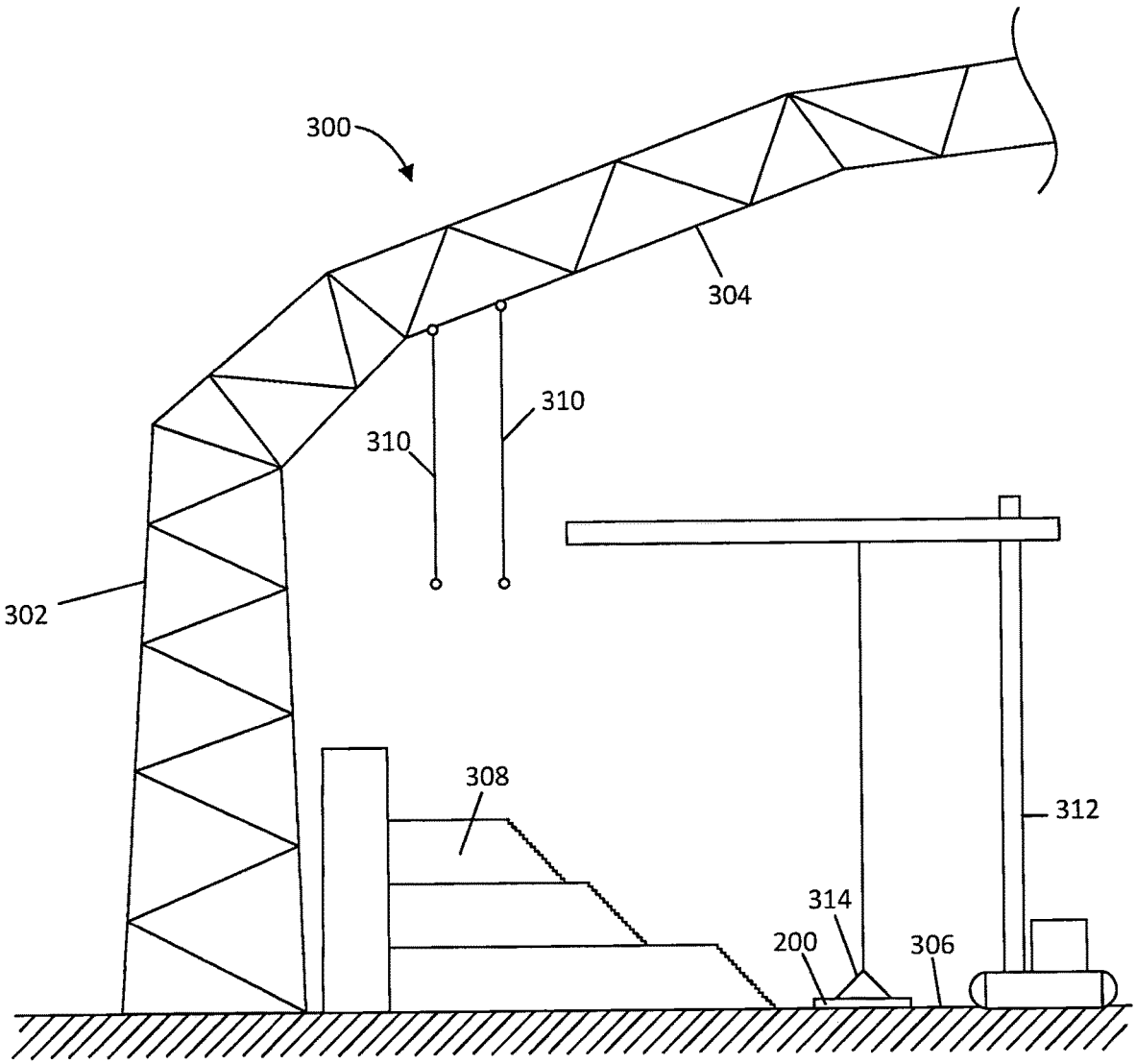
Figure 3D:
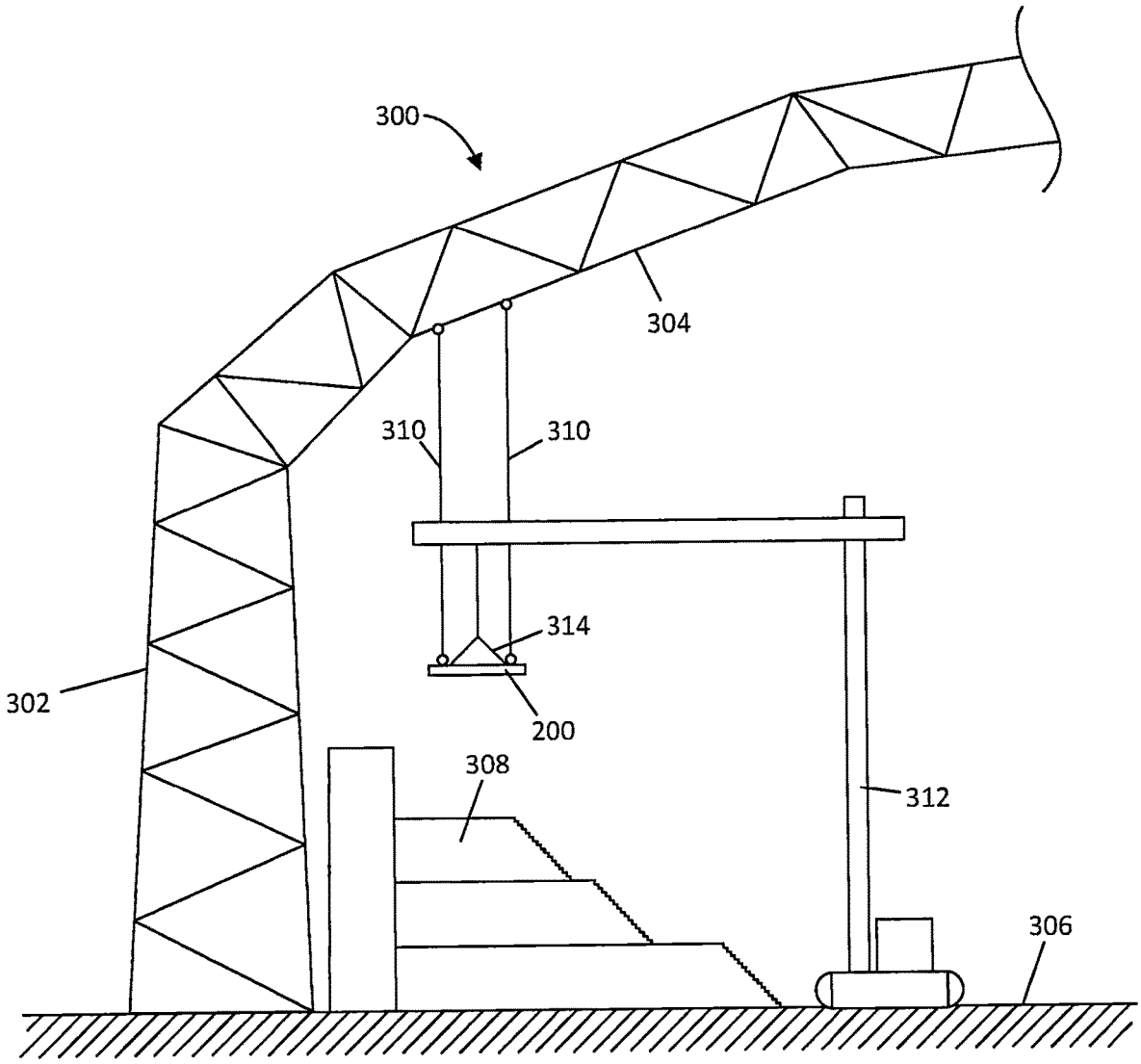

Now with reference to FIG. 3C, the crane 312 is attached to the platform 200 using a sling 314, which may be a heavy duty polyester sling, at ground level 306. The crane 312 then lifts and moves the platform 200 using the sling 314 to the lower end of the hoists 310 where the hoists 310 are attached to the platform 200 at a first elevated position according to step 106. Notably, because of the presence of the lower bowl seating 308, the platform 200 needs to be lifted and attached mid-air (e.g., above ground level 306) at a first elevated position. With the platform 200 attached to the hoists 310, the sling 314 may be detached and the crane 312 withdrawn.

Figure 3E:
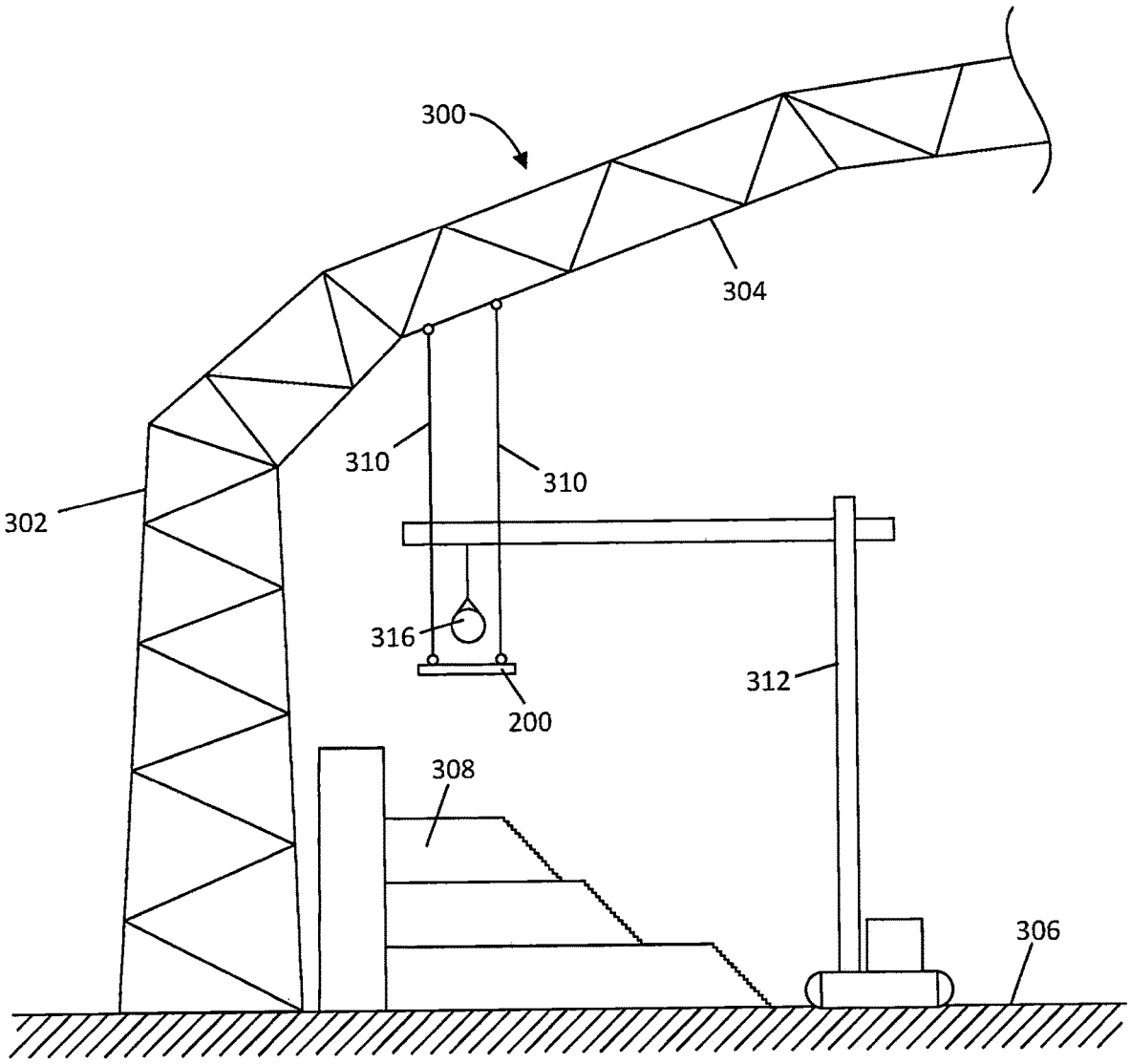

Turning to FIG. 3E, the crane 312 may then be used to lift an item 316 to the platform 200 with the platform at the first elevated position according to a step 108 of the method 100. The item 316 may be for example, an HVAC duct, but is not so limited. Because the platform 200 is rated to lift 5,000 pounds, the platform 200 can support extremely heavy items. Once the item 300 is placed on the platform 200, the crane 312 is withdrawn as illustrated in FIG. 3F (although the crane 312 likely remains in the area).

Figure 3F:
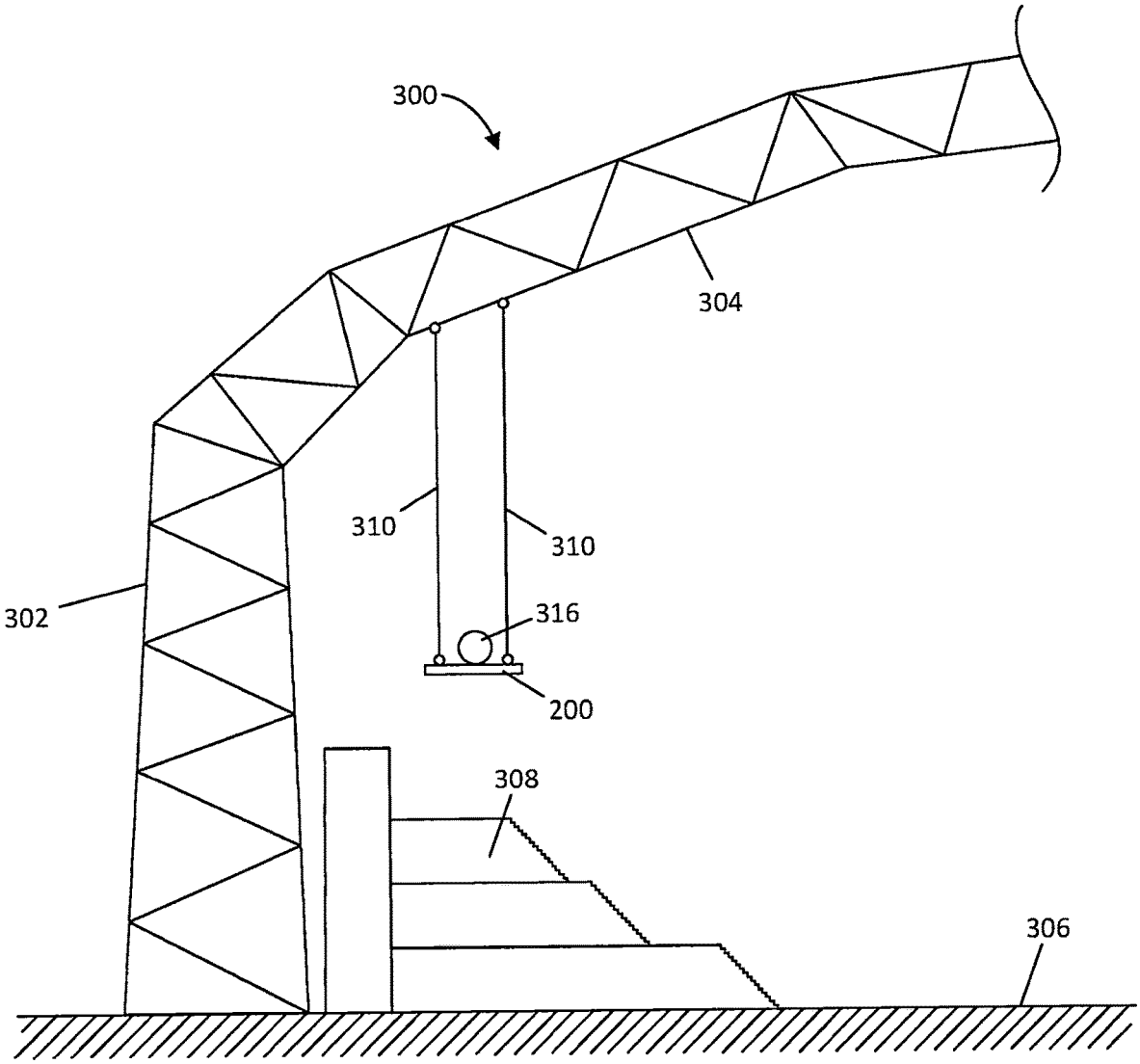
Figure 3G:
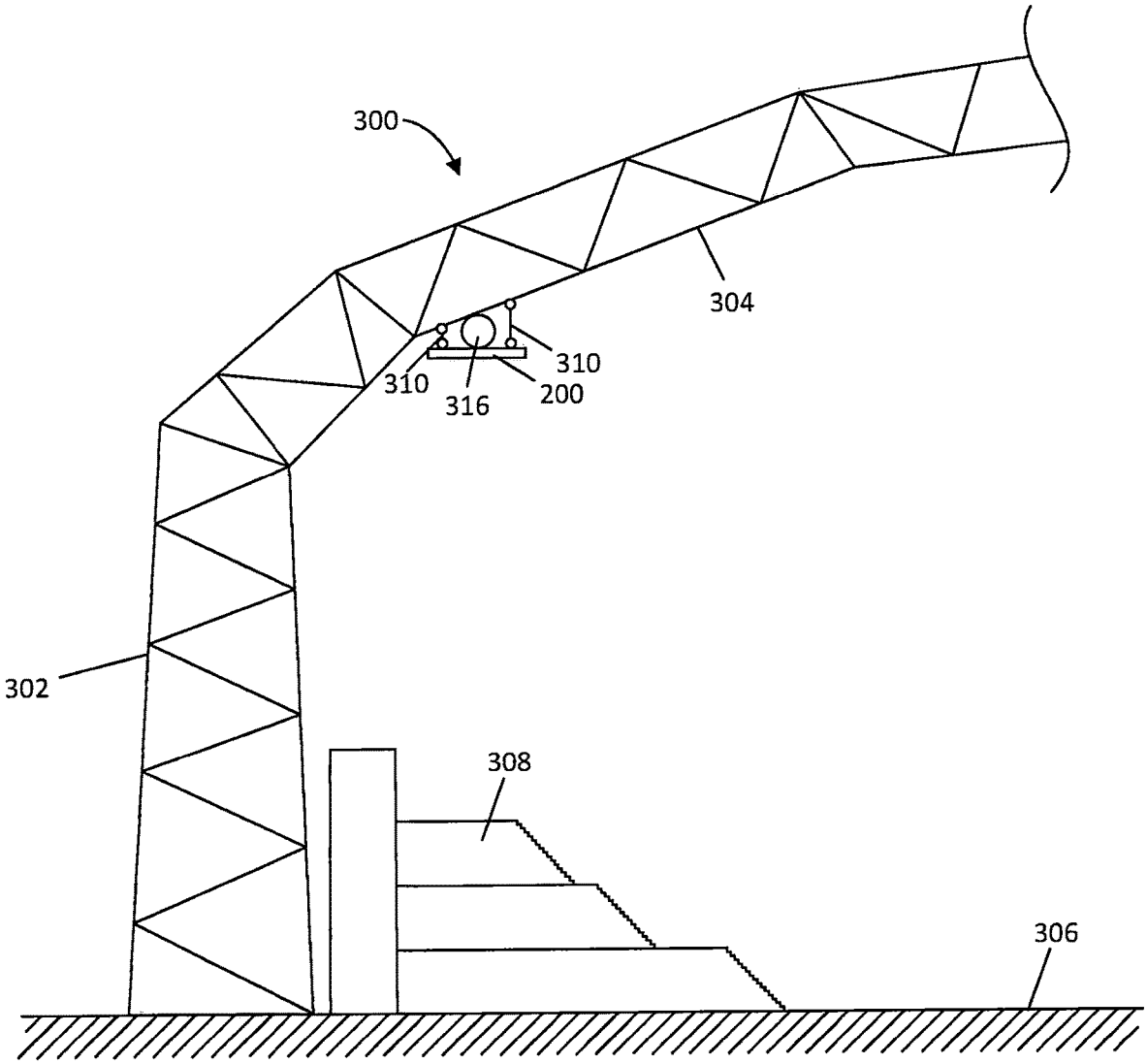

With the crane 312 withdrawn, the hoists 310 may now be used to lift the platform 200 from the first elevated position illustrated in FIG. 3F to a second elevated position illustrated in FIG. 3G at which the item 300 is moved or lifted to an installation position according to a step 110. Workers may stand on the platform and finely manipulate the position of the item 316 relative to where it needs to be positioned to be installed and then install the item 316 in place according to step 112.

This general methodology of lifting heavy items to great heights may be supplemented in various ways.

For instance, multiple platforms may be used to create a row of installation points. Such platforms may be "walked" or "swung" from one location forward by re-rigging and adjustment to create a continually forward moving series or chain of platforms in which one or two platforms serve as points of installation, while other platform(s) are moved to the next position for operation.

Further yet, the platform may be lowered again from an elevated height near the installation point back down to a lower point after each "walk" or "swing" of a platform to reload the platform with an item and lift the item back up the higher, second elevation point at which it is to be installed. Thus, once a platform is up in position (e.g., after the sequence of steps 102-106 have been completed), the platform may effectively be repositioned by further rigging and adjustment of hoists making the platform a flying platform until the installation job is done.

It is contemplated further that in some instances, such as were the architecture of the structure is incredibly complex (e.g., has a steep roof or low overhang), the flying platform concept may be used to walk or swing items into otherwise difficult areas to reach using a crane alone. Thus, the system and method offers incredibly diverse and flexible positioning options which may not be achieved using conventional methods.

Figure 4A:
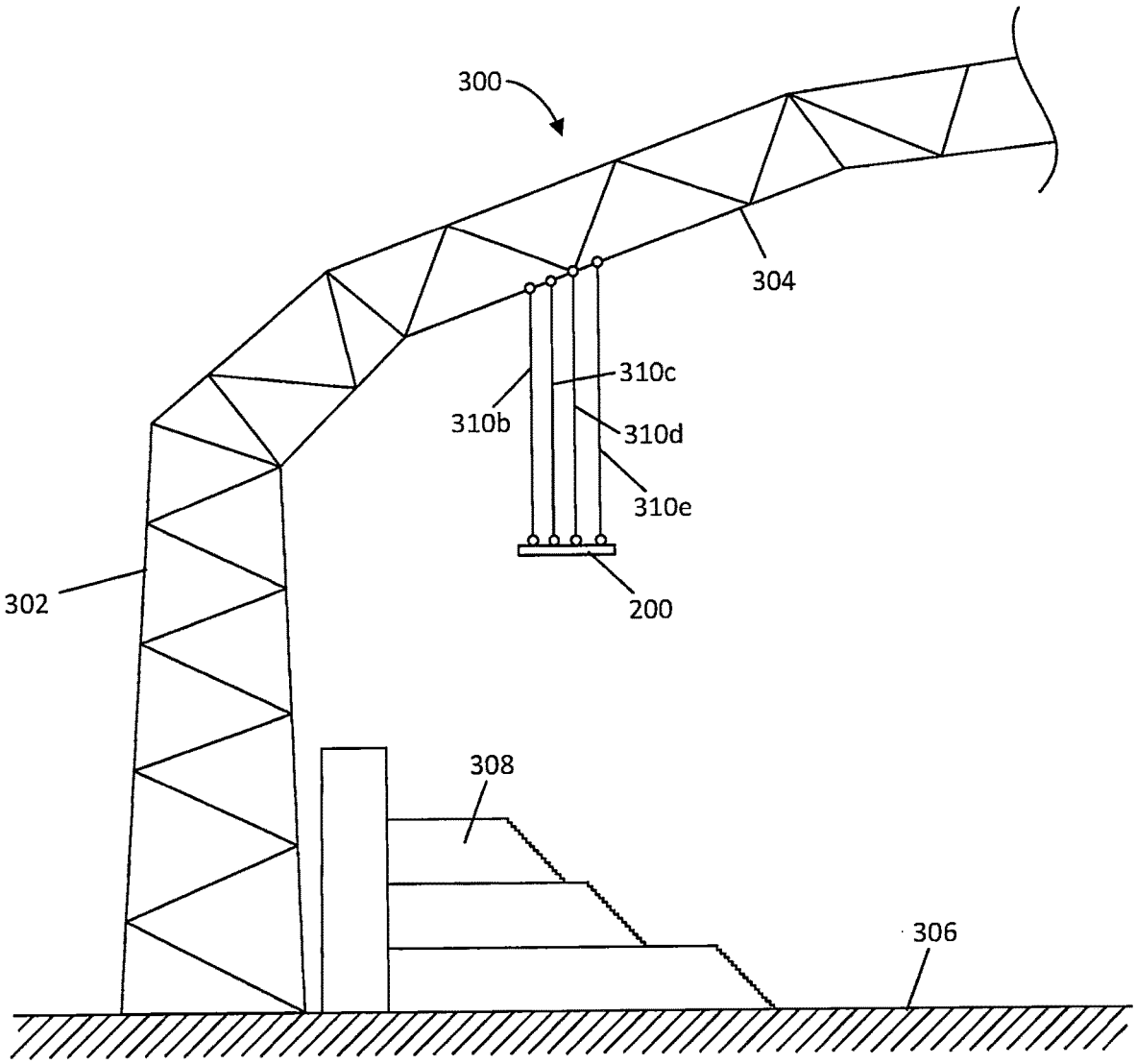
FIGS. 4A-4D are a view of the representative portion of the structure in which hoists have been hung from the roof above the obstacle beneath, a platform (such as the platform of FIGS. 2A and 2B) has been constructed at ground level, and a crane has been brought into this portion of the stadium.
Figure 4B:
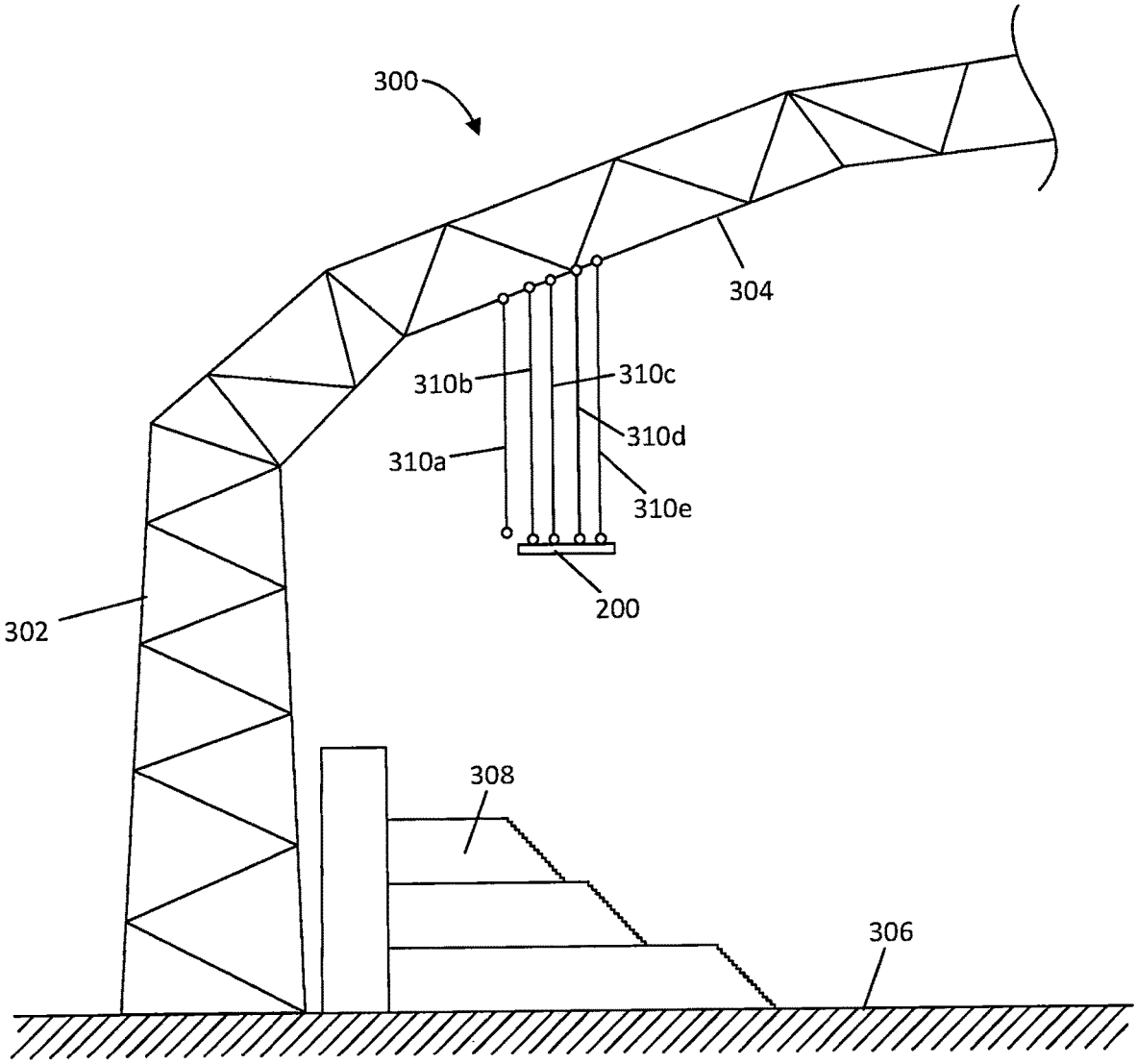
Figure 4C:
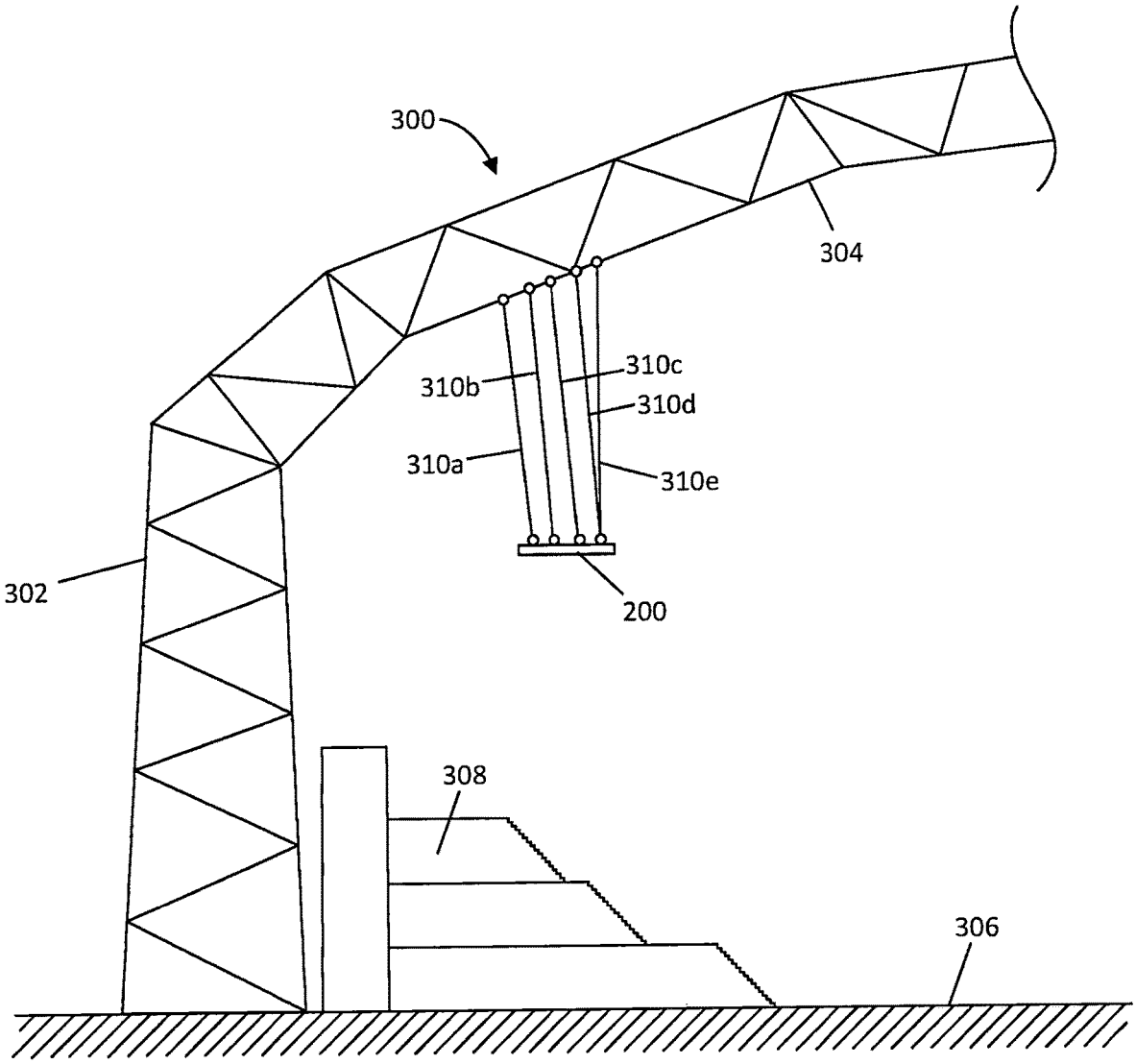
Figure 4D:
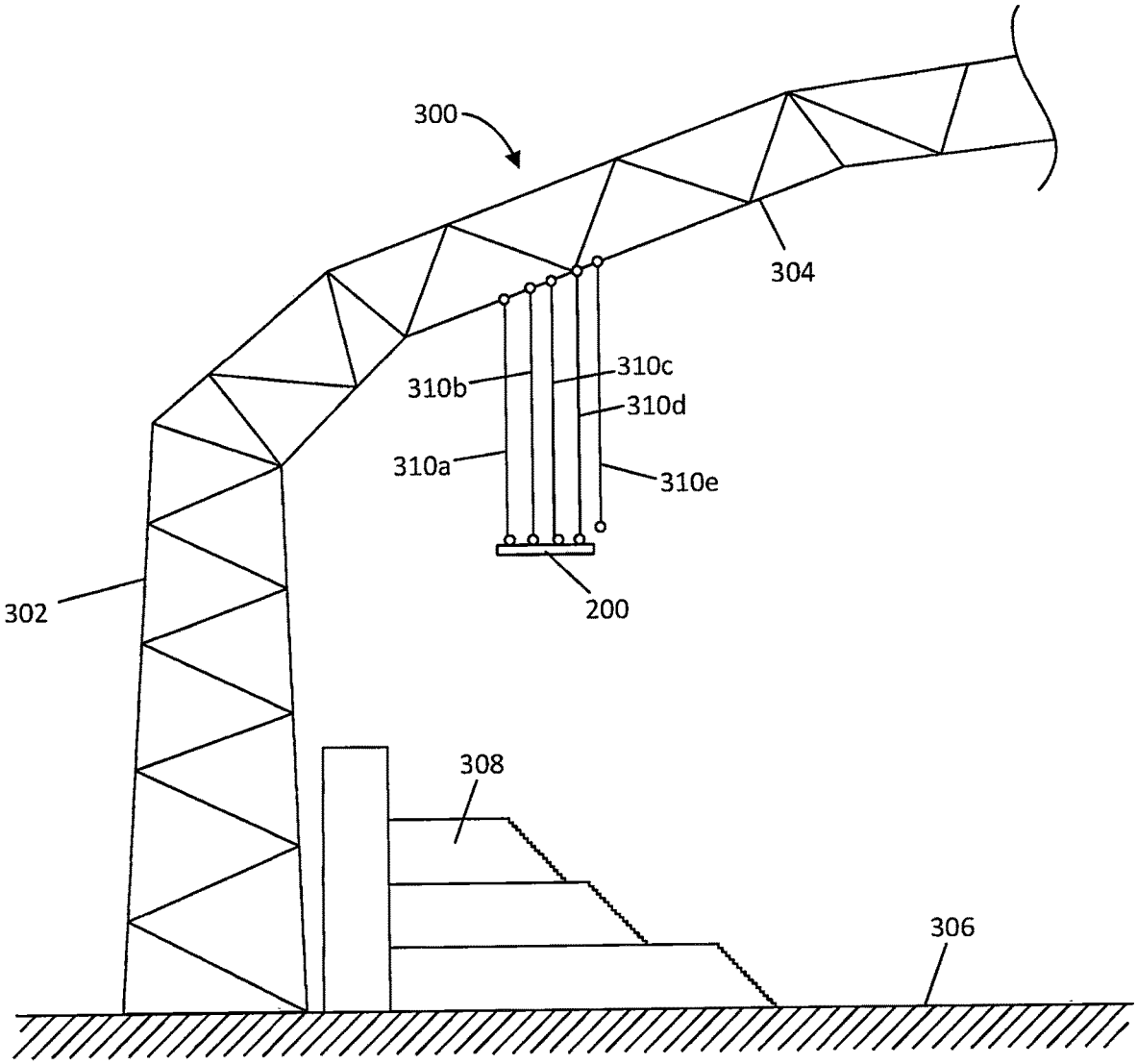

Turning now to FIGS. 4A-4D, an exemplary sequence of steps is illustrated for "walking" a platform at an elevated height in a direction that is, at least in part, horizontal. In FIG. 4A, it can be seen that four hoists 310*b-e* (which may have a complementary parallel set of hoists on the other side of the platform) are attached to the platform 200. As illustrated in FIG. 4B, a new, unattached hoist 310*a* is attached adjacent a position to the platform 200. The leftmost connected hoist 310*b* might then be disconnected and each hoist 310*a-d* angled over one as illustrated in FIG. 4C until the right most hoist 310*e* is detached, permitting the platform 200 to shift leftward relative to the depiction on the page.

It will be appreciated that movement or walking by detaching and attaching of additional hoists may be performed in a number of ways and the specific number of detachments and re-attachments may be altered based on the weight of the platform and the degree and type of movement to be effectuated.

Further yet, it is contemplated that in some forms one platform may be moved more dramatically under or around the side of other stationary platforms to create an advancing chain of platforms. The only significant limitation on the types of movement the platforms might make with respect to one another are the limitations relating to rigging the platform to the roof via the hoists and finding ways to clear the other stationary platforms which are already in place. Because such platforms are being moved high over the ground (typically in excess of tens or hundreds of feet), extreme caution should be maintained when re-re-rigging and moving any of the platforms.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of installing an item at an elevated height on a structure, the method comprising:

hanging hoists from the structure;

moving a platform from ground level and positioning the platform at a first elevated position between ground level and the hoists;

attaching the platform to the hoists at the first elevated position;

moving the item onto the platform after the platform has been attached to the hoists;

lifting the item on the platform to a second elevated position for installation at the elevated height on the structure; and installing the item at the elevated height.

2. The method of claim 1 wherein the step of installing the item at elevated height involves mechanically attaching the item to the structure for support by the structure independent of support by the platform.

3. The method of claim 1 further comprising the step of assembling the platform at ground level prior to picking up the platform.

4. The method of claim 3 wherein the platform is assembled from multiple joined truss sections with walkboards received thereon and railing supported thereby.

5. The method of claim 1 wherein a portion of the structure is located directly beneath an installation site at the elevated height at which the item is installed.

6. The method of claim 5 wherein the structure is a stadium and the portion of the structure that is located directly beneath the installation site is bowl seating.

7. The method of claim 1 wherein the item is an HVAC duct.

8. The method of claim 1 wherein the platform comprises a super duty truss supporting aluminum walk boards.

9. The method of claim 1 wherein the step of moving a platform from ground level and positioning the platform at a first elevated position between ground level and the hoists involves raising and positioning the platform with a crane.

10. The method of claim 1 wherein the platform is supported by a heavy duty polyester sling when the platform is positioned with the crane.

11. The method of claim 1 wherein the step of hanging hoists on the structure is performed by riggers.

12. The method of claim 1 further comprising moving the platform from a second elevated position to a third elevated position by attaching the platform to an additional subset of hoists in which the additional subset of hoists includes hoists not included in an original subset of hoists attached to the platform and detaching at least a portion of the subset of original hoists.

13. The method of claim 12 wherein the attaching and detaching of subsets of hoists results in the walking the platform, at least partially in a horizontal direction relative to ground level.

14. The method of claim 13 wherein the method comprising walking the platform a plurality of times, each time lowering the platform to receive a new item and then lifting the new item back up, to install multiple items over a distance.

15. The method of claim 12 wherein the method comprising walking the platform places of the platform in the structure at a location at which a crane would be incapable of placing the platform based on a geometry of the roof under which the platform is to be positioned.

16. The method of claim 1 wherein the hoists are operable using a control system.

17. The method of claim 16 wherein the hoists are independently operable by the control system.

18. The method of claim 16 wherein the control system is a remote control system.

19. The method of claim 1 wherein the platform is vertically movable over a distance exceeding 200 feet by the hoists.

20. The method of claim 1 wherein the platform has a gross capacity of 35,280 pounds.

21. The method of claim 1 wherein hang the hoists from the structure involves linking the hoists to a system of cables running between beams.

* * * * *